US011705651B2

(12) United States Patent
Yamanaka et al.

(10) Patent No.: US 11,705,651 B2
(45) Date of Patent: Jul. 18, 2023

(54) PRESS-FIT TERMINAL

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Takuya Yamanaka, Yokkaichi (JP); Tetsuya Ito, Yokkaichi (JP); Shinji Iihoshi, Yokkaichi (JP); Kentaro Hirai, Yokkaichi (JP); Takashi Tonosaki, Yokkaichi (JP); Mitsugu Furutani, Yokkaichi (JP); Shigeki Shimada, Osaka (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 142 days.

(21) Appl. No.: 17/419,184

(22) PCT Filed: Dec. 17, 2019

(86) PCT No.: PCT/JP2019/049328
§ 371 (c)(1),
(2) Date: Jun. 28, 2021

(87) PCT Pub. No.: WO2020/137676
PCT Pub. Date: Jul. 2, 2020

(65) Prior Publication Data

US 2022/0115795 A1 Apr. 14, 2022

(30) Foreign Application Priority Data

Dec. 28, 2018 (JP) ..... 2018-246779

(51) Int. Cl.
*H01R 12/58* (2011.01)

(52) U.S. Cl.
CPC ..... *H01R 12/585* (2013.01)

(58) Field of Classification Search
CPC ..... H01R 12/585
See application file for complete search history.

(56) References Cited

U.S. PATENT DOCUMENTS 7,491,897 B2 2/2009 Watanabe et al.
9,742,081 B1 * 8/2017 Annis ..... H01R 12/7082
(Continued)

FOREIGN PATENT DOCUMENTS

JP H05-166556 A 7/1993
JP 2004-127610 A 4/2004
JP 2012-169190 A 9/2012

OTHER PUBLICATIONS

Mar. 17, 2020 International Search Report issued in International Patent Application No. PCT/JP2019/049328.

*Primary Examiner* — Truc T Nguyen
(74) *Attorney, Agent, or Firm* — Oliff PLC

(57) ABSTRACT

A press-fit terminal inserted into through hole of a circuit board along insertion direction includes a base portion extending in insertion direction, distal end portion, and two deformable portions. The distal end portion is on a front side to base portion in insertion direction and includes distal end portion side corner portions. The two deformable portions connect base portion and distal end portion and are contacted with an inner wall of through hole and elastically deformed. The two deformable portions include deformable portion side corner portions and deformable portion side corner portions include outer deformable portion side corner portions on outer side in direction crossing insertion direction. The two deformable portions include easy deformable portions, in portions having outer deformable portion side
(Continued)

corner portions with curved surfaces whose radius of curvature RL is greater than a radius of curvature RS of curved surfaces of distal end portion side corner portions.

12 Claims, 9 Drawing Sheets

(56) References Cited

U.S. PATENT DOCUMENTS

| | | | | |
|---|---|---|---|---|
| 2004/0145880 | A1 | 7/2004 | Watanabe et al. | |
| 2005/0250356 | A1* | 11/2005 | Matsumura | H01R 12/585 439/82 |
| 2007/0010139 | A1* | 1/2007 | Chen | H01R 12/585 439/751 |
| 2013/0165001 | A1* | 6/2013 | Kataoka | H01R 12/585 439/889 |
| 2019/0074613 | A1* | 3/2019 | Ochi | H01R 12/585 |
| 2019/0280406 | A1* | 9/2019 | Zhang | H01R 12/585 |
| 2020/0021047 | A1* | 1/2020 | Kishibata | H01R 12/585 |
| 2020/0076099 | A1* | 3/2020 | Chalas | H01R 13/6471 |
| 2020/0388943 | A1* | 12/2020 | He | H01R 12/585 |
| 2022/0166156 | A1* | 5/2022 | Hata | H01R 12/585 |

* cited by examiner

PRESS-FIT TERMINAL

TECHNICAL FIELD

The technology disclosed herein relates to a press-fit terminal.

BACKGROUND ART

There has been known a press-fit terminal that is pressed into a through hole of a circuit board so as to be electrically connected to a conductive circuit arranged on the circuit board without using solder and to be mechanically contacted and fixed to the circuit board (refer to Japanese Unexamined Patent Application Publication No. 2004-127610). The press-fit terminal includes a pair of elastic contact portions that are spaced away from each other. The elastic contact portions are inserted into the through hole while being elastically deformed to become closer to each other. Then, the elastic contact portions are contacted with a conductive layer provided on an inner surface of the through hole due to the elastic restoring force of the elastic contact portions and electric connection is established.

RELATED ART DOCUMENT

Patent Document

[Patent Document 1] Japanese Unexamined Patent Application Publication No. 2004-127610

SUMMARY OF THE INVENTION

Problem to be Solved by the Invention

To ensure connection reliability in the press-fit terminal having the above configuration, it is desirable that the elastic contact portions are surely contacted with the conductive layer on the inner wall of the through hole. However, if the load applied by the elastic contact portions to the inner wall of the through hole is too great, great strain may be caused in the terminal and this is not preferable. Particularly, relatively great strain tends to be caused in a branch portion of the press-fit terminal where the press-fit terminal is branched into the two elastic contact portions in an insertion leading end side portion thereof.

The technology described herein was accomplished in view of the foregoing circumstances. An object of the present technology is to provide a press-fit terminal that reduces insertion force when being inserted into a through hole while keeping connection reliability.

Means for Solving the Problem

A technology described herein is a press-fit terminal to be inserted into a through hole of a circuit board along an insertion direction. The press-fit terminal includes a base portion extending in the insertion direction, a distal end portion that is on a front side with respect to the base portion in the insertion direction and includes distal end portion side corner portions, and at least two deformable portions connecting the base portion and the distal end portion and being to be contacted with an inner wall of the through hole and elastically deformed. Each of the at least two deformable portions includes deformable portion side corner portions and the deformable portion side corner portions include outer deformable portion side corner portions on an outer side in a direction crossing the insertion direction. The at least two deformable portions include easy deformable portions, respectively, in portions thereof having the outer deformable portion side corner portions with curved surfaces whose radius of curvature is greater than a radius of curvature of curved surfaces of the distal end portion side corner portions.

According to the above configuration, since the radius of curvature of the curved surfaces of the outer deformable portion side corner portions is relatively great in the easy deformable portions of the respective two deformable portions, the easy deformable portions are easily moved closer to the inner wall of the through hole. Accordingly, the elastic deformation amount of the two deformable portions becomes smaller and this can reduce the insertion force required for inserting the press-fit terminal into the through hole.

According to the above configuration, since the radius of curvature of the curved surfaces of the distal end portion side corner portions is relatively small, the cross-sectional area of the distal end portion is relatively large. According to such a configuration, the rigidity of the distal end portion is relatively great and the load applied by the two deformable portions to the inner wall of the through hole can be maintained. As a result, the holding force of the press-fit terminal is less likely to be lowered.

Embodiments of the technology described herein may preferably have following configurations.

The at least two deformable portions may include the easy deformable portions, respectively, in portions thereof having a largest width dimension ranging the at least two deformable portions in the direction crossing the insertion direction.

According to the above configuration, the portions having the largest width dimension ranging the two deformable portions in the direction crossing the insertion direction are to be surely contacted with the inner wall of the through hole. Since the easy deformable portions are included in the portions having the largest width dimension, respectively, the deformation amount of the two deformable portions can be surely reduced. Accordingly, the insertion force of the press-fit terminal can be surely reduced.

The deformable portions may include the respective easy deformable portions, respectively, also in portions thereof on a rear side in the insertion direction with respect to the portions having the largest width dimension ranging the at least two deformable portions in the direction crossing the insertion direction.

According to the above configuration, the deformation amount of the two deformable portions can be further reduced in the portions of the deformable portions on the rear side (in the insertion direction) with respect to the portions having the largest width dimension that extends in the direction crossing the insertion direction. Accordingly, the insertion force of the press-fit terminal can be further reduced.

Each of the at least two deformable portions may include a middle portion between the distal end portion and each of the easy deformable portions. The middle portion may include middle portion side corner portions having curved surfaces whose radius of curvature gently changes from the radius of curvature of the distal end portion side corner portions to the radius of curvature of the outer deformable portion side corner portions.

According to the above configuration, the curved surfaces extending from the respective distal end portion side corner portions to the respective outer deformable portion side corner portions have the radius of curvature that gently changes. Accordingly, the inner surface of the through hole is less likely to be damaged and the connection reliability of the press-fit terminal is improved.

Advantageous Effects of Invention

According to the technology described herein, a press-fit terminal that reduces insertion force when inserted into a through hole and keeps connection reliability is obtained.

MODES FOR CARRYING OUT THE INVENTION

First Embodiment

A first embodiment according to the technology described herein will be described with reference to FIGS. 1 to 9. A press-fit terminal 10 according to the present embodiment is to be inserted into a through hole of a circuit board 30 in an insertion direction (a direction represented by an arrow A) and held therein. In the following description, a lower side and an upper side in FIG. 1 correspond to a front side and a rear side with respect to the insertion direction, respectively.

Circuit Board 30

Figure 1:
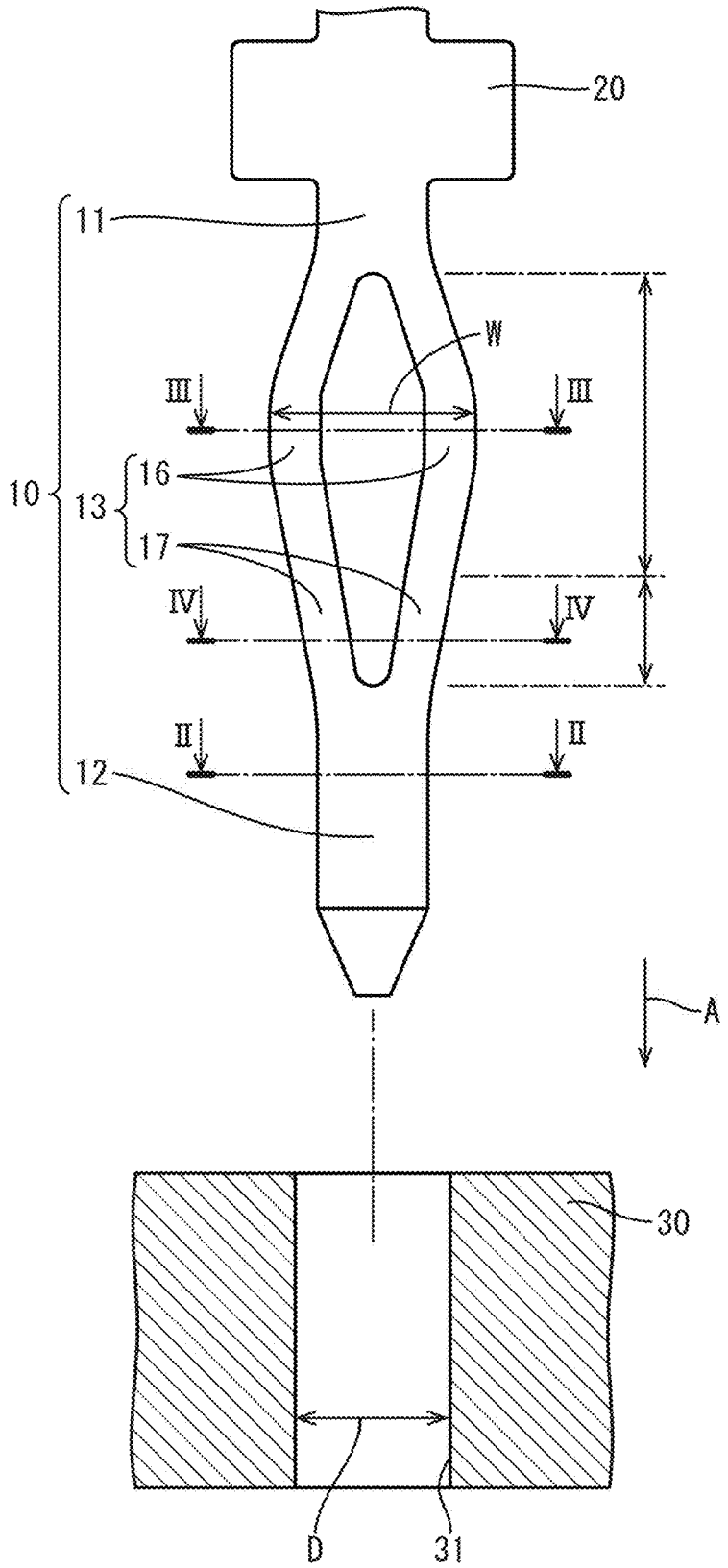
FIG. 1 is a partially enlarged cross-sectional view illustrating a press-fit terminal according to a first embodiment and a through hole of a circuit board.

As illustrated in FIG. 1, the circuit board 30 is a printed circuit board having a general configuration and includes a glass substrate and electrically conductive wirings (not illustrated) formed with a printing wiring technology on front and rear surfaces of an insulating plate made of insulation material such as a glass non-woven substrate. The circuit board 30 includes through holes 31. Each of the through holes 31 extends through the circuit board 30 from one surface to another surface of the circuit board 30. Each through hole 31 includes a conductive layer (not illustrated) on the inner surface thereof and the conducive layer is electrically connected to the conductive wirings with a known method such as plating.

Press-Fit Terminal 10

As illustrated in FIG. 1, the press-fit terminal 10 is formed by pressing a metal plate having good electric conductive property such as copper and copper alloy. The press-fit terminal 10 includes a base portion 11 having a substantially square bar shape, a distal end portion 12 having a substantially square bar shape, and two (a pair of) deformable portions 13. The distal end portion 12 is on a front side with respect to the base portion 11 in the insertion direction. The deformable portions 13 connect the base portion 11 and the distal end portion 12. The base portion 11 includes a stopper portion 20 that projects in a direction perpendicular to the insertion direction. The stopper portion 20 receives a load that is applied thereto by a jig, which is not illustrated, when the press-fit terminal 10 is inserted to the circuit board 30.

Each of the two deformable portions 13 has a substantially narrow square bar shape. The two deformable portions 13 are spaced away from each other in a direction crossing the insertion direction to the through hole 31.

The two deformable portions 13 are elastically deformable in a direction so as to become closer to each other. In a normal state (when no force is applied to the deformable portions 13), a largest width dimension W ranging the two deformable portions (a dimension between outer edges of the deformable portions 13) is greater than the diameter D of the through hole 31.

The distal end portion 12 is tapered toward a front end with respect to the insertion direction (an end opposite from the deformable portions 13) and extends in the insertion direction.

Figure 2:
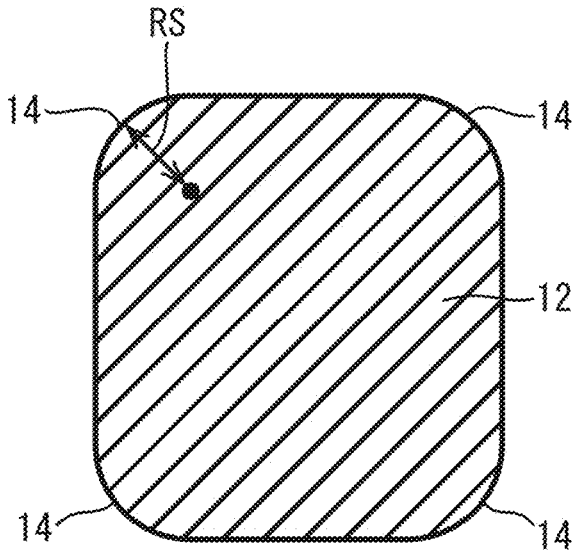
FIG. 2 is a cross-sectional view taken along II-II line in FIG. 1.

As illustrated in FIG. 2, the distal end portion 12 includes four distal end portion side corner portions 14 that extend in the insertion direction and each of the distal end portion side corner portions 14 has a curved surface. As illustrated in FIG. 2, the distal end portion 12 has a square cross-sectional shape having rounded corners.

Figure 3:
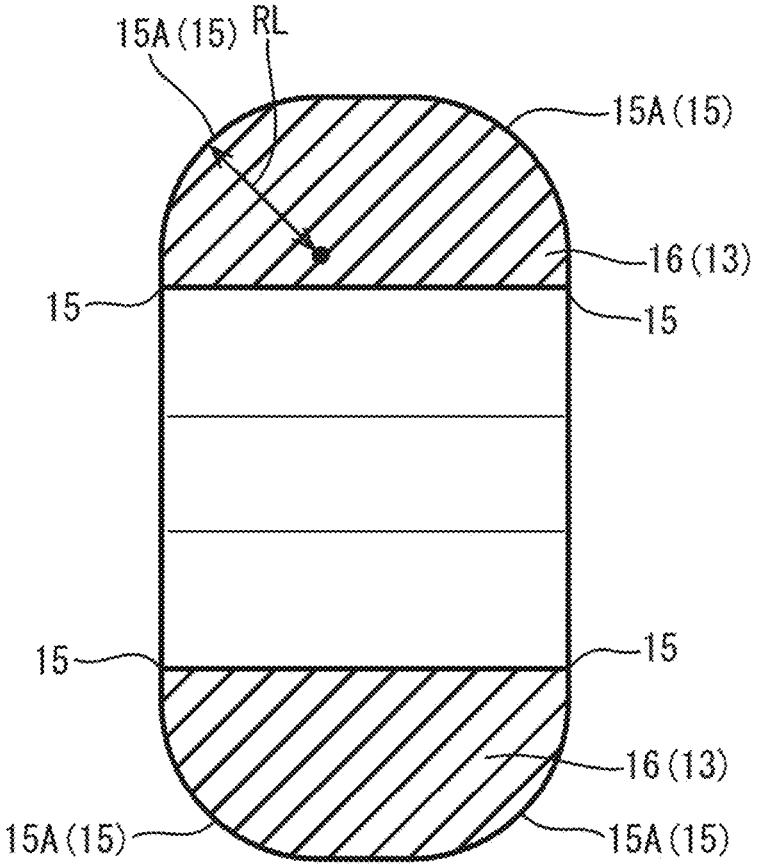
FIG. 3 is a cross-sectional view taken along III-III line in FIG. 1.

As illustrated in FIG. 3, each of the two deformable portions 13 includes four deformable portion side corner portions 15 that extend in the insertion direction. Among the four deformable portion side corner portions 15 of each deformable portion 13, two deformable portion side corner portions 15A on an outer side with respect to the direction crossing the insertion direction have curved surfaces.

As illustrated in FIG. 1, in a portion of about two third of each deformable portion 13 from the rear end thereof with respect to the insertion direction, the radius of curvature RL of the curved surface of the deformable portion side corner portion 15A is greater than the radius of curvature RS of the curved surface of the distal end portion side corner portion 14. According to such a configuration, the cross-sectional shape of each deformable portion 13 is a rounded shape as a whole.

The portions of the respective two deformable portions 13 having the radius of curvature RL greater than the radius of curvature LS of the distal end portion 12 are easy deformable portions 16. As illustrated in FIG. 1, the deformable portions 13 include the respective easy deformable portions 16 in the portions thereof having the largest width dimension W that extends in the direction crossing the insertion direction. Further, the deformable portions 13 include the respective easy deformable portions 16 also in the portions thereof on the rear side with respect to the portions having the largest width dimension W in the insertion direction.

Figure 4:
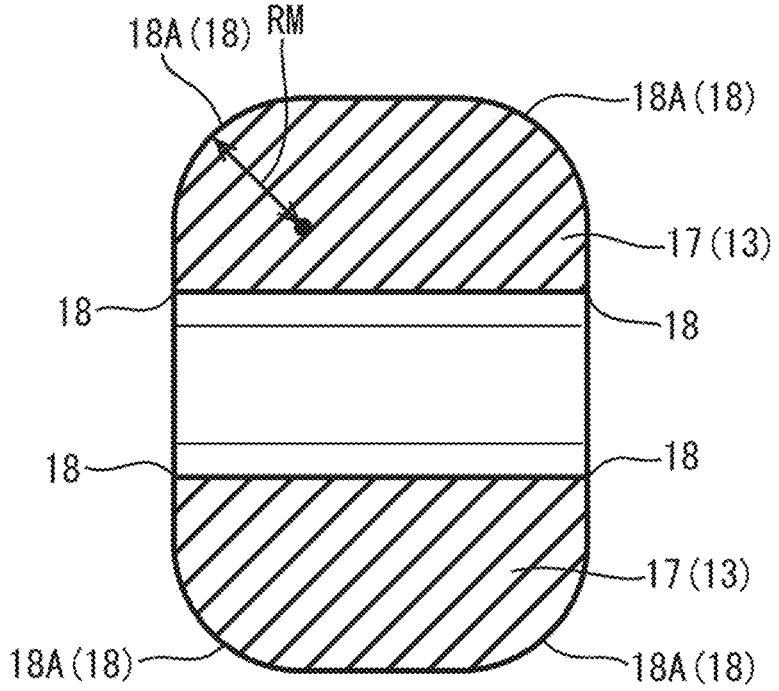
FIG. 4 is a cross-sectional view taken along IV-IV line in FIG. 1.
Figure 5:
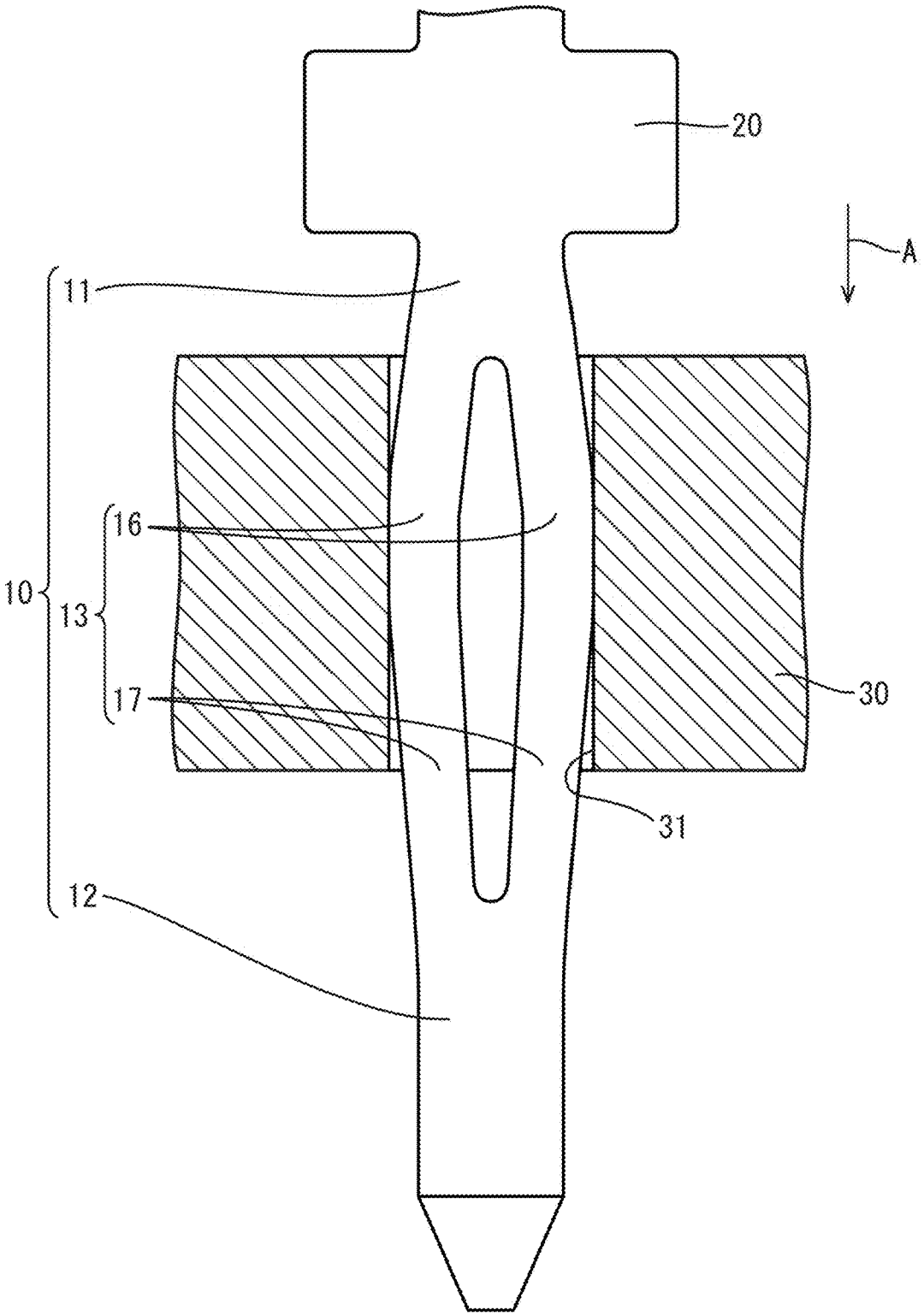
FIG. 5 is a partially enlarged cross-sectional view illustrating the press-fit terminal that is inserted in the through hole of the circuit board.

A portion of about one third of each deformable portion 13 from the front end thereof with respect to the insertion direction is a middle portion 17. As illustrated in FIG. 4, each of the middle portions 17 includes four middle portion side corner portions 18 that extend in the insertion direction. The middle portion side corner portions 18 include middle portion side corner portions 18A that are on an outer side with respect to the direction crossing the insertion direction and have curved surfaces. The radius of curvature RM of the curved surfaces of the middle portion side corner portions 18A gently changes from the radius of curvature RS of the curved surfaces of the distal end portion side corner portions 14 of the distal end portion 12 to the radius of curvature RL of the curved surfaces of the deformable portion side corner portion 15A of the easy deformable portions 16.

Steps of Inserting Press-Fit Terminal 10

Next, steps of inserting the press-fit terminal 10 into the through hole 31 will be described. The distal end portion 12 of the press-fit terminal 10 is positioned with respect to the through hole 31 and inserted into the through ole 31.

The press-fit terminal 10 is further pressed frontward in the insertion direction and the outer edges of the two deformable portions 13 slide along a hole edge of the through hole 31. Accordingly, the two deformable portions 13 are guided into the through hole 31 and are inserted into the through hole 31 while being elastically deformed to become closer to each other.

When the deformable portions 13 are inserted to a correct position (a position illustrated in FIG. 5), the portions of the deformable portions 13 having the largest width dimension W ranging the two deformable portions 13 in the direction crossing the insertion direction are contacted with the inner wall (an inner wall of a conductive layer) of the through hole 31. Then, the two deformable portions 13 are pressed to the inner wall of the through hole 31 due to the resilient force of the two deformable portions 13. This electrically connects the press-fit terminal 10 and the conductive layer.

Description of Example and Comparative Examples

Figure 6:
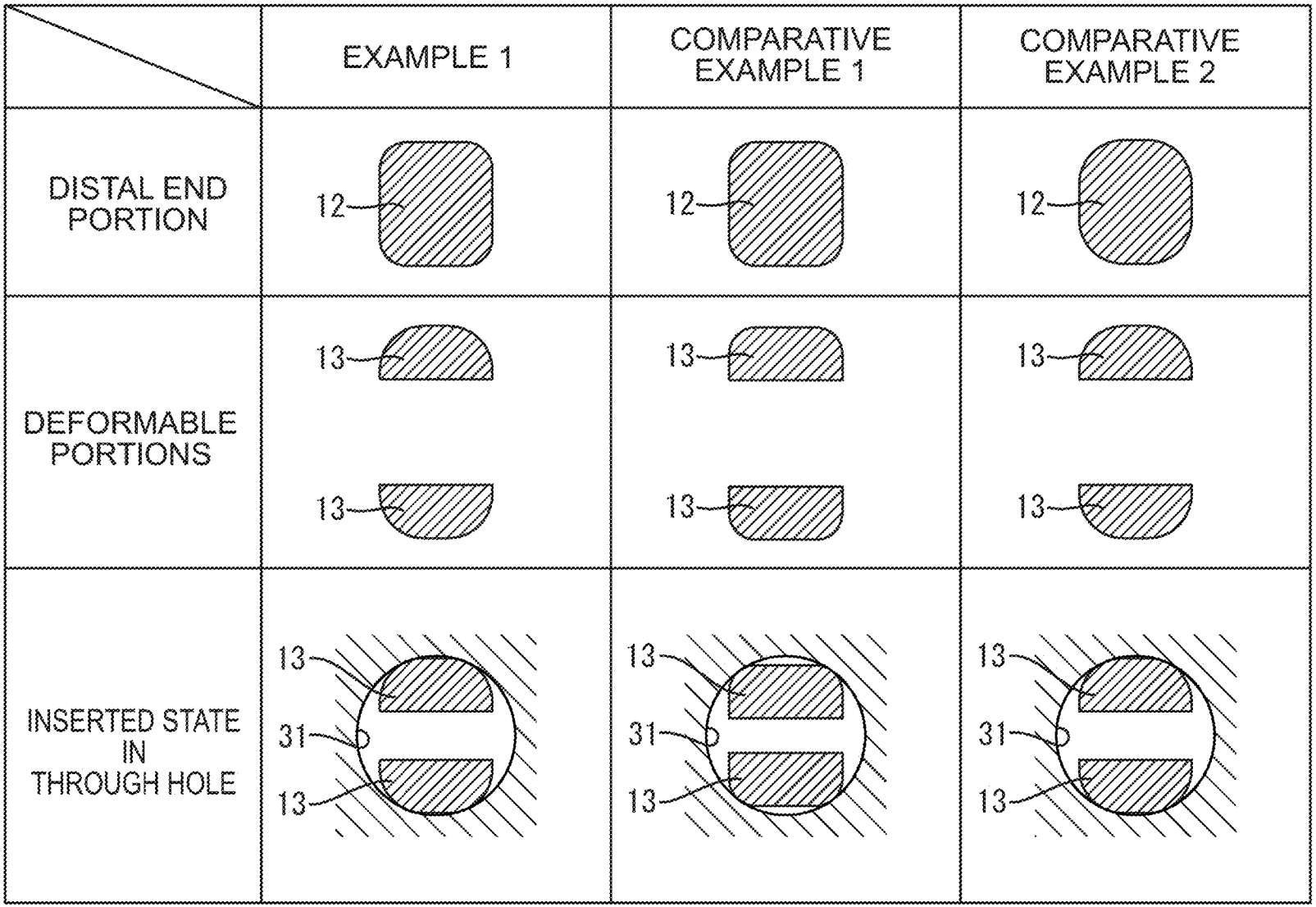
FIG. 6 includes a partially enlarged cross-sectional views schematically illustrating EXAMPLE 1, COMPARATIVE EXAMPLE 1, and COMPARATIVE EXAMPLE 2.

Next, the technology described herein will be described more in detail with reference to EXAMPLE and COMPARATIVE EXAMPLES. With reference to FIG. 6, the press-fit terminal 10 according to EXAMPLE 1, COMPARATIVE EXAMPLE 1 and COMPARATIVE EXAMPLE 2 will be described.

In EXAMPLE 1, the radius of curvature RL of the curved surfaces of the deformable portion side corner portions 15A is greater than the radius of curvature RS of the curved surfaces of the distal end portion side corner portion 14.

In COMPARATIVE EXAMPLE 1 and COMPARATIVE EXAMPLE 2, the radius of curvature of the curved surfaces of the deformable portion side corner portions 15A is equal to the radius of curvature of the curved surfaces of the distal end portion side corner portions 14. In COMPARATIVE EXAMPLE 1, the radius of curvature of the curved surfaces of the deformable portion side corner portions 15A and that of the curved surfaces of the distal end portion side corner portions 14 are equal to the radius of curvature of the curved surfaces of the distal end portion side corner portions 14 of EXAMPLE 1. In COMPARATIVE EXAMPLE 2, the radius of curvature of the curved surfaces of the deformable portion side corner portions 15A and that of the curved surfaces of the distal end portion side corner portions 14 are equal to the radius of curvature of the curved surfaces of the deformable portion side corner portions 15A of EXAMPLE 1.

Figure 9:
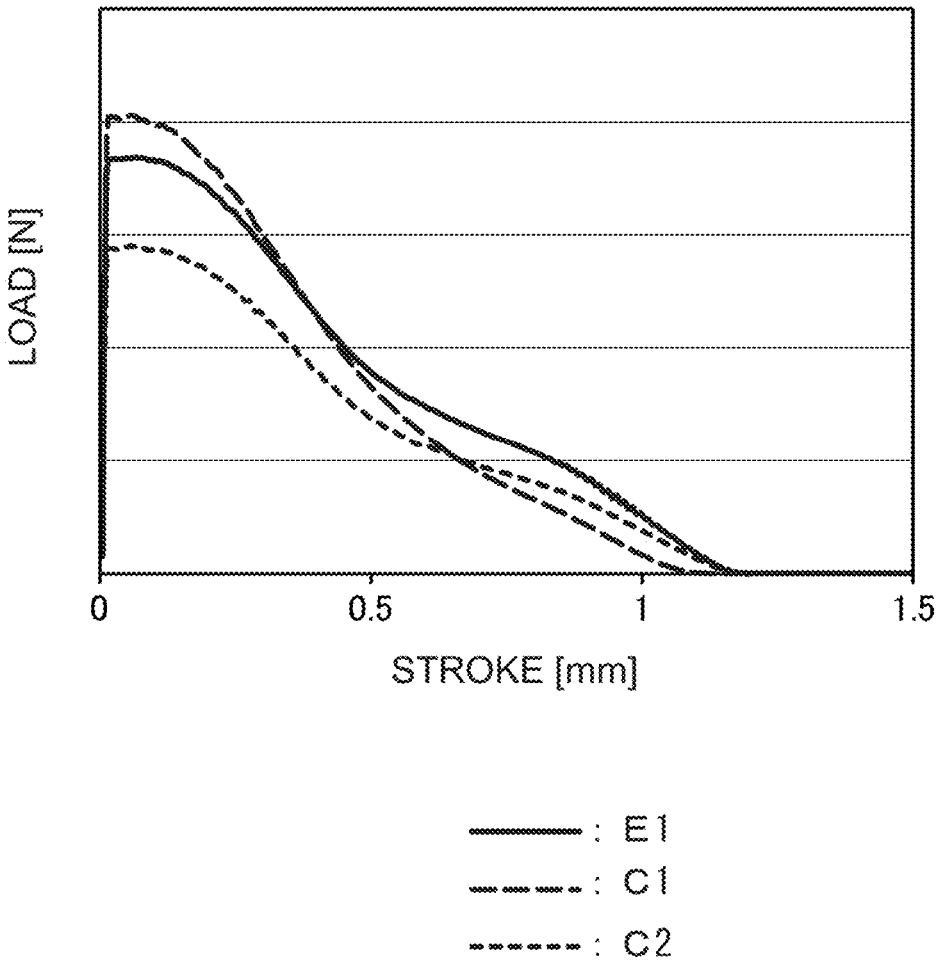
FIG. 9 is a graph representing relations between pulled-out lengths and pulling loads.

The CAE (Computer Aided Engineering) analysis was performed for the insertion force and the holding force in EXAMPLE 1, COMPARATIVE EXAMPLE 1 and COMPARATIVE EXAMPLE 2. The results for the insertion force are illustrated in FIG. 7 and the results for the holding force are illustrated in FIG. 9.

Insertion Load

Figure 7:
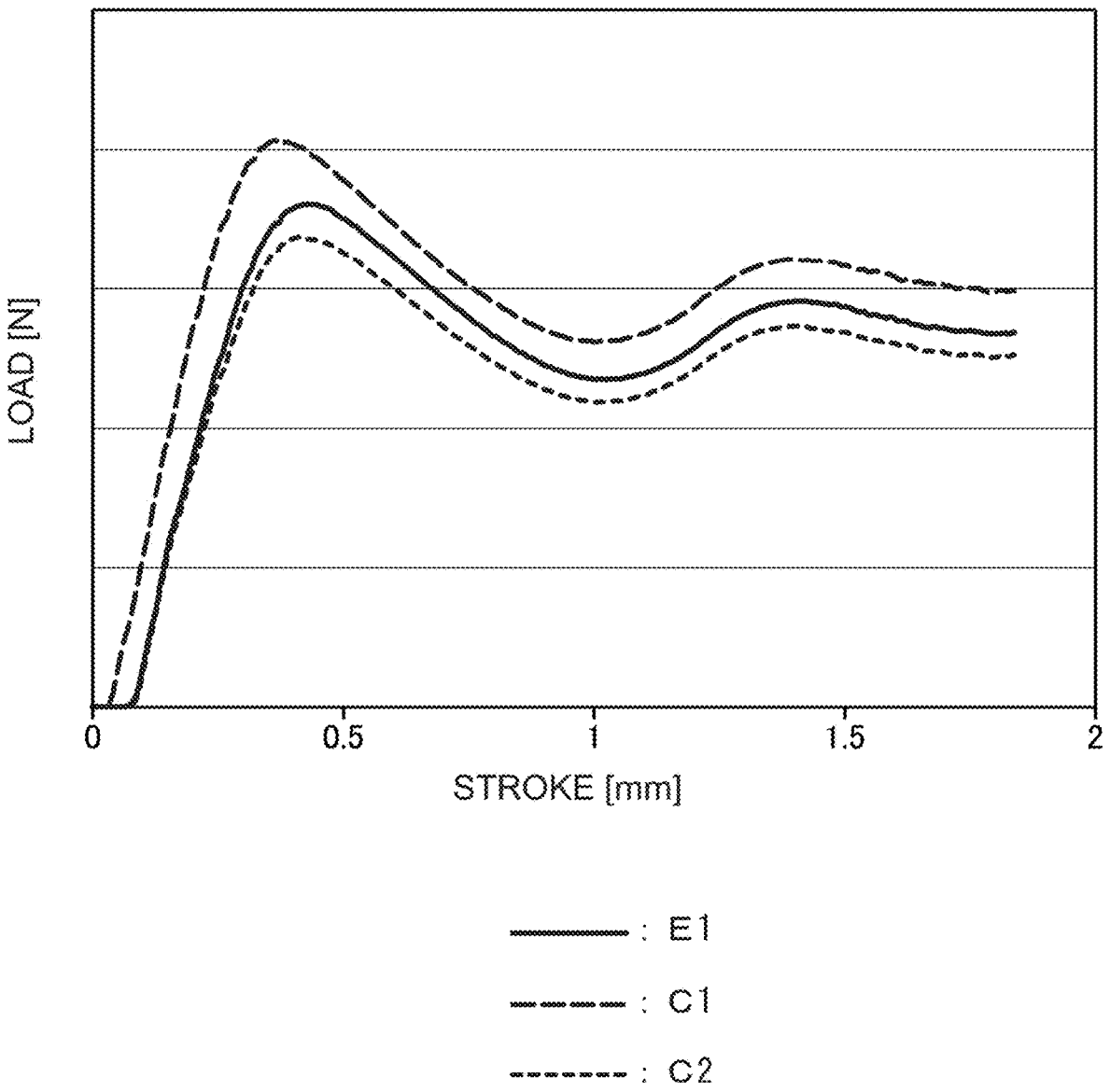
FIG. 7 is a graph representing relations between inserted lengths and insertion loads.

FIG. 7 illustrates the relations between inserted lengths (stroke) and insertion loads when the press-fit terminal 10 is inserted into the through hole 31. A solid line E1 represents the analysis results of EXAMPLE 1, a rough broken line C1 represents the analysis results of COMPARATIVE EXAMPLE 1, and a fine broken line C2 represents the analysis results of COMPARATIVE EXAMPLE 2. The values of the inserted lengths are examples and not limited to the values described herein.

The tendency that is common to EXAMPLE 1, COMPARATIVE EXAMPLE 1 and COMPARATIVE EXAMPLE 2 will be described. The insertion load monotonically increases until the inserted length reaches 0.5 mm from 0 mm. The insertion load monotonically decreases after the inserted length is over 0.5 mm. The insertion load reaches a first peak when the inserted length is near about 0.5 mm.

The insertion load monotonically increases when the inserted length is within a range from 1 mm to 1.5 mm, and the insertion load monotonically decreases after the inserted length is over 1.5 mm. The insertion load reaches a second peak when the inserted length is near about 1.5 mm. The insertion of the press-fit terminal 10 into the through hole 31 is completed while the inserted length is within a range from 1.5 mm to 2 mm.

The insertion load (the insertion force) is defined as force for pressing the press-fit terminal 10 frontward in the insertion direction against the resilient force of the two deformable portions 13. Therefore, the amount of the insertion load depends on the deformation amount of the two deformable portions 13.

As illustrated in FIG. 6, in COMPARATIVE EXAMPLE 1, the radius of curvature of the curved surfaces of the deformable portion side corner portions 15A is smaller than the radius of curvature of the curved surfaces of the deformable portion side corner portions 15A of EXAMPLE 1 and COMPARATIVE EXAMPLE 2. With such a configuration, the outer edges of the deformable portions 13 that are inserted in the through hole 31 are elastically deformed to be spaced away from the inner wall of the through hole 31. Namely, the elastic deformation amount of the two deformable portions 13 of COMPARATIVE EXAMPLE 1 is greater than the elastic deformation amount of the two deformable portions 13 of each of EXAMPLE 1 and COMPARATIVE EXAMPLE 2. As a result, the insertion load in COMPARATIVE EXAMPLE 1 is greater than that in each of EXAMPLE 1 and COMPARATIVE EXAMPLE 2.

The insertion load in COMPARATIVE EXAMPLE 2 is smaller than that in EXAMPLE 1 since the radius of curvature of the curved surfaces of the distal end portion side corner portions 14 of COMPARATIVE EXAMPLE 2 is greater than the radius of curvature of the curved surfaces of the distal end portion side corner portions 14 of EXAMPLE 1 and the cross-sectional area of the distal end portion 12 of COMPARATIVE EXAMPLE 2 is smaller than the cross-sectional area of the distal end portion 12 of EXAMPLE 1. The insertion load is smaller in COMPARATIVE EXAMPLE 2 than in EXAMPLE 1 and the small insertion load lowers the holding force as will be described later and is not preferable.

Figure 8:
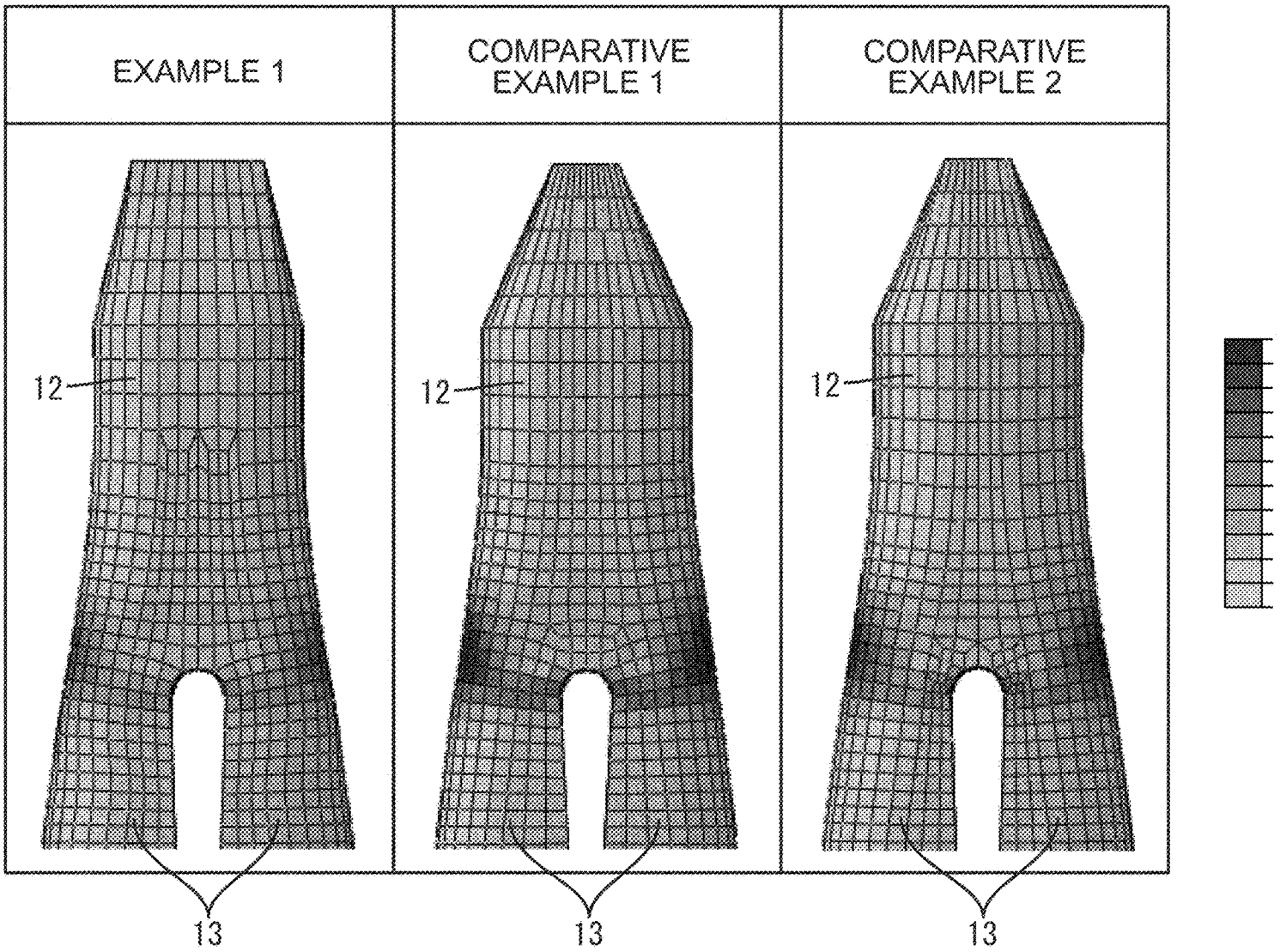
FIG. 8 includes schematic views illustrating distal end portions with strains.

FIG. 8 illustrates strains that are caused in the distal end portion 12 that is inserted in the correct position within the through hole 31 according to each of EXAMPLE 1, COMPARATIVE EXAMPLE 1, and COMPARATIVE EXAMPLE 2. In the drawing, the color becomes darker as the strain becomes greater. As previously described, the two deformable portions 13 of COMPARATIVE EXAMPLE 1 are elastically deformed greatly in the direction to be closer to each other. Therefore, the strain is caused in the distal end portion 12 of COMPARATIVE EXAMPLE 1 such that the outer edge portion thereof in the direction crossing the insertion direction are stretched in the opposite directions with respect to the insertion direction.

The deformation amount of the two deformable portions 13 of COMPARATIVE EXAMPLE 2 is smaller than that of COMPARATIVE EXAMPLE 1 since the radius of curvature of the curved surfaces of the deformable portion side corner portions 15A of COMPARATIVE EXAMPLE 2 is greater than the radius of curvature of the curved surfaces of the deformable portion side corner portions 15A of COMPARATIVE EXAMPLE 1. Therefore, the strain caused in the distal end portion 12 of COMPARATIVE EXAMPLE 2 is smaller than that of COMPARATIVE EXAMPLE 1.

The deformation amount of the two deformable portions 13 of EXAMPLE 1 is smaller than that of COMPARATIVE EXAMPLE 1 since the radius of curvature RL of the curved surfaces of the deformable portion side corner portions 15A of EXAMPLE 1 is greater than the radius of curvature of the curved surfaces of the deformable portion side corner portions 15A of COMPARATIVE EXAMPLE 1. Furthermore, the cross-sectional area of the distal end portion 12 of EXAMPLE 1 is greater than the cross-sectional area of the distal end portion 12 of COMPARATIVE EXAMPLE 2 since the radius of curvature RS of the curved surfaces of the distal end portion side corner portions 14 of EXAMPLE 1 is smaller than the radius of curvature of the curved surfaces of the distal end portion side corner portions 14 of COMPARATIVE EXAMPLE 2. As a result, the distal end portion 12 of EXAMPLE 1 is less likely to have strains than the distal end portion 12 of COMPARATIVE EXAMPLE 2.

Holding Force

FIG. 9 illustrates the relations of the pulled-out lengths (stroke) and the pulling loads (holding force) when the press-fit terminal 10 is pulled out of the through hole 31. A solid line E1 represents the analysis results of EXAMPLE 1, a rough broken line C1 represents the analysis results of COMPARATIVE EXAMPLE 1, and a fine broken line C2 represents the analysis results of COMPARATIVE EXAMPLE 2. The values of the pulled-out lengths are examples and not limited to the values described herein.

The pulling load is zero when the pulled-out length is 0 mm. When the pulled-out length is greater than 0 mm, the pulling load abruptly increases to be a greatest value. Thereafter, the pulling load monotonically decreases as the pulled-out length increases. When the pulled-out length becomes greater than about 1 mm, the two deformable portions 13 become away from the inner wall of the through hole 31 and the pulling load becomes zero.

As previously described, the cross-sectional areas of the respective distal end portions 12 of COMPARATIVE EXAMPLE 1 and EXAMPLE 1 are greater than the cross-sectional area of the distal end portion 12 of COMPARATIVE EXAMPLE 2. Therefore, the pulling loads of the press-fit terminals 10 of COMPARATIVE EXAMPLE 1 and EXAMPLE 1 are greater than that of COMPARATIVE EXAMPLE 2. This enables EXAMPLE 1 to obtain the holding force substantially same as that of COMPARATIVE EXAMPLE 1. On the other hand, the press-fit terminal 10 of COMPARATIVE EXAMPLE 2 is less likely to obtain effective holding force since the cross-sectional area of the distal end portion 12 is relatively small in COMPARATIVE EXAMPLE 2.

Description of Operations and Advantageous Effects of the Present Embodiment

Next, operations and advantageous effects of the present embodiment will be described. The press-fit terminal 10 of the present embodiment is the press-fit terminal 10 that is to be inserted in the through hole 31 of the circuit board 30 along the insertion direction. The press-fit terminal 10 includes the base portion 11 extending in the insertion direction, the distal end portion 12, and the pair of deformable portions 13. The distal end portion 12 is on the front side with respect to the base portion 11 in the insertion direction and includes the distal end side corner portions 14. The two deformable portions 13 connect the base portion 11 and the distal end portion 12 and are to be contacted with the inner wall of the through hole 31 and elastically deformed. The two deformable portions 13 include the deformable portion side corner portions 15. The two deformable portions 13 include the easy deformable portions 16, respectively. The deformable portion side corner portions 15 include the outer deformable portion side corner portions 15A on the outer side with respect to the direction crossing the insertion direction. The radius of curvature RL of the curved surfaces of the deformable portion side corner portions 15A of the easy deformable portions 16 is greater than the radius of curvature RS of the curved surfaces of the distal end portion side corner portions 14.

According to the above configuration, since the radius of curvature RL of the curved surfaces of the deformable portion side corner portions 15A is relatively great in the easy deformable portions 16 of the respective two deformable portions 13, the easy deformable portions 16 are easily moved closer to the inner wall of the through hole 31. Accordingly, the elastic deformation amount of the two deformable portions 13 becomes smaller and this can reduce the insertion force required for inserting the press-fit terminal 10 into the through hole 31.

According to the above configuration, since the radius of curvature RS of the curved surfaces of the distal end portion side corner portions 14 is relatively small, the cross-sectional area of the distal end portion 12 is relatively large. According to such a configuration, the rigidity of the distal end portion 12 is relatively great and the load applied by the two deformable portions 13 to the inner wall of the through hole 31 can be maintained. As a result, the holding force of the press-fit terminal 10 is less likely to be lowered.

According to the present embodiment, the two deformable portions 13 include the easy deformable portions 16 in the portions thereof having the largest width dimension W ranging the two deformable portions 13 in the direction crossing the insertion direction.

According to the above configuration, the portions having the largest width dimension W ranging the two deformable portions 13 in the direction crossing the insertion direction are to be surely contacted with the inner wall of the through hole 31. Since the easy deformable portions 16 are included in the portions having the largest width dimension W, respectively, the deformation amount of the two deformable portions 13 can be surely reduced. Accordingly, the insertion force of the press-fit terminal 10 can be surely reduced.

According to the present embodiment, the easy deformable portions 16 are included also in the portions of the deformable portions 13 on the rear side with respect to the portions (in the insertion direction) having the largest width dimension W that extends in the direction crossing the insertion direction.

According to the above configuration, the deformation amount of the two deformable portions 13 can be further reduced in the portions of the deformable portions on the rear side (in the insertion direction) with respect to the portions having the largest width dimension W that extends in the direction crossing the insertion direction. Accordingly, the insertion force of the press-fit terminal 10 can be further reduced.

According to the present embodiment, the two deformable portions 13 include the middle portions 17, respectively, between the distal end portion 12 and the respective easy deformable portions 16. The middle portions 17 include the middle portion side corner portions 18A. The radius of curvature RM of the curved surfaces of the middle portion side corner portions 18A gently changes from the radius of curvature RS of the curved surfaces of the distal end portion side corner portions 14 to the radius of curvature of the deformable portion side corner portion 15A.

According to the above configuration, the curved surfaces extending from the respective distal end portion side corner portions 14 to the respective deformable portion side corner portions 15A have the radius of curvature RM that gently changes. Accordingly, the inner surface of the through hole 31 is less likely to be damaged and the connection reliability of the press-fit terminal 10 is improved.

Other Embodiments

The technology disclosed herein is not limited to the embodiment described above and illustrated in the drawings. For example, the following embodiments will be included in the technical scope of the technology.

(1) The press-fit terminal 10 may not include the middle portions 17 and the entire deformation portions 13 may be configured as the easy deformable portions 16.

(2) The deformable portions 13 may include the easy deformable portions 16 in portions thereof other than the portions having the largest width dimension W ranging the two deformable portions 13.

(3) The radius of curvature RM of the curved surfaces of the middle portion side corner portions 18 may not gently change from the radius of curvature of the distal end portion side corner portions 14 to the radius of curvature of the deformable portion side corner portion 15A. For example, the radius of curvature RM of the curved surfaces of the middle portion side corner portions 18 may be same as the radius of curvature RS of the distal end portion side corner portions 14 or same as the radius of curvature RL of the deformable portion side corner portions 15A. The radius of curvature RM of the curved surfaces of the middle portion side corner portions 18 may be different from the radius of curvature RS of the distal end portion side corner portions 14 and the radius of curvature RL of the deformable portion side corner portions 15A.

EXPLANATION OF SYMBOLS

10: Press-fit terminal
11: Base portion
12: Distal end portion
13: Deformable portion
14: Distal end portion side corner portion
15, 15A: Deformable portion side corner portion
16: Easy deformable portion
17: Middle portion
18, 18A: Middle portion side corner portion
30: Circuit board
31: Through hole
A: Insertion direction
W: Width dimension
RL: Radius of curvature of the curved surface of the deformable portion side corner portion
RS: Radius of curvature of the curved surface of the distal end portion side corner portion
RM: Radius of curvature of the curved surface of the middle portion side corner portion

The invention claimed is:

1. A press-fit terminal to be inserted into a through hole of a circuit board along an insertion direction, the press-fit terminal comprising:

a base portion extending in the insertion direction;

a distal end portion that is on a front side with respect to the base portion in the insertion direction and includes distal end portion side corner portions; and at least two deformable portions connecting the base portion and the distal end portion and being configured to contact an inner wall of the through hole and elastically deform, and being configured such that no contact occurs between the at least two deformable portions in a state of maximum deformation of the at least two deformable portions due to the contact with the inner wall of the through hole, wherein each of the at least two deformable portions includes outer deformable portion side corner portions that are continuous with the distal end portion side corner portions, and the at least two deformable portions include easy deformable portions, respectively, in portions thereof having the outer deformable portion side corner portions with curved surfaces whose radius of curvature is greater than a radius of curvature of curved surfaces of the distal end portion side corner portions.

2. The press-fit terminal according to claim 1, wherein the easy deformable portions respectively include first portions at which a dimension between outer edges of the at least two deformable portions is largest.

3. The press-fit terminal according to claim 2, wherein easy deformable portions respectively include second portions disposed on a rear side in the insertion direction with respect to the first portions.

4. The press-fit terminal according to claim 1, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

5. The press-fit terminal according to claim 2, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

6. The press-fit terminal according to claim 3, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

7. A press-fit terminal to be inserted into a through hole of a circuit board along an insertion direction, the press-fit terminal comprising:

a base portion extending in the insertion direction;

a distal end portion that is on a front side with respect to the base portion in the insertion direction and includes distal end portion side corner portions; and at least two deformable portions connecting the base portion and the distal end portion and configured to contact an inner wall of the through hole and elastically deform, wherein each of the at least two deformable portions has a cross-sectional shape perpendicular to the insertion direction, and each cross-sectional shape has a line of symmetry parallel to a deformation direction in which the at least two deformable portions are to be elastically deformed, each of the at least two deformable portions includes outer deformable portion side corner portions that are continuous with the distal end portion side corner portions, and the at least two deformable portions include easy deformable portions, respectively, in portions thereof having the outer deformable portion side corner portions with curved surfaces whose radius of curvature is greater than a radius of curvature of curved surfaces of the distal end portion side corner portions.

8. The press-fit terminal according to claim 7, wherein the easy deformable portions respectively include first portions at which a dimension between outer edges of the at least two deformable portions is largest.

9. The press-fit terminal according to claim 8, wherein the easy deformable portions respectively include second portions disposed on a rear side in the insertion direction with respect to the first portions.

10. The press-fit terminal according to claim 7, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

11. The press-fit terminal according to claim 8, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

12. The press-fit terminal according to claim 9, wherein each of the at least two deformable portions includes a middle portion between the distal end portion and each of the easy deformable portions, and the middle portion includes middle portion side corner portions having curved surfaces whose radius of curvature gently changes from the radius of curvature of the distal end portion side corner portions to the radius of curvature of the outer deformable portion side corner portions.

* * * * *